United States Patent [19]

Davis

[11] Patent Number: 4,819,940

[45] Date of Patent: Apr. 11, 1989

[54] GOLF STANCE TRAINING AID

[76] Inventor: Eddie L. Davis, 2704 Rincon Dr., Grand Junction, Colo. 81503

[21] Appl. No.: 179,072

[22] Filed: Apr. 8, 1988

[51] Int. Cl.[4] ..... A63B 69/36; A43B 5/00; A43C 15/00

[52] U.S. Cl. ..... 273/187 B; 273/32 C; 36/127; 36/134

[58] Field of Search ..... 273/32 C; 36/88, 127, 36/134, 62; 128/584, 585, 80 D, 80 J

[56] References Cited

U.S. PATENT DOCUMENTS

| | | | |
|---|---|---|---|
| 3,086,522 | 4/1963 | Frohmader | 128/80 J |
| 3,218,734 | 9/1963 | O'Brien | 273/32 C |
| 3,866,339 | 2/1975 | Latto | 36/127 |
| 4,081,918 | 4/1978 | O'Brien | 273/32 C |
| 4,118,034 | 10/1978 | O'Brien | 273/32 C |
| 4,704,809 | 11/1987 | Ballard | 273/32 C |

*Primary Examiner*—Maryann Lastova
*Assistant Examiner*—Valerie Szczepanik
*Attorney, Agent, or Firm*—Donald W. Erickson

[57] ABSTRACT

A device to aid in the teaching of a good or correct golf swing. The device is a generally wedge shaped bar which, when attached to the bottom outer edge of the shoe, causes the foot to tilt inwardly and forwardly simultaneously. The golfer thereby achieves a correct golf stance which is vital to a good golf swing. Through use of the device in practice over a period of time, the leg and foot muscles become toned or conditioned to automatically assume the correct stance when the golfer addresses the ball.

4 Claims, 2 Drawing Sheets

GOLF STANCE TRAINING AID

BACKGROUND OF THE INVENTION

This invention is directed at a teaching aid for golf which places the golfer in the correct stance or posture when addressing the ball and enables the golfer to make a good or correct swing.

A good golf swing, consistently done, is characteristic of and essential to a no handicap or low handicap golfer. In a good or correct golf swing, a transfer of weight distribution begins to the inside of the right leg and foot. At about half way through the back swing, the main weight is transferred to the inside right leg and foot and the hip turns automatically with the weight transfer. At the top of the back swing and before the start of the down swing, the weight of the golfer should be about seventy percent coiled against the inside of the right leg and foot. At this point, the weight should be principally on the ball of the right foot. At the start of the down swing, a transfer of weight begins from the inside of the right leg and ball of the foot to the left leg and ball of the foot so as to drive with the legs and the turn of the hips. Upon completion of the golf swing, the golfer should have transferred about ninety percent of his or her weight to the left leg and ball of the foot. This provides the golfer with both a good and powerful swing.

Various devices and theories are described in the prior art which are intended to assist the golfer in correct stance and swing. Schlesinger, U.S. Pat. Nos. 2,847,769 and 2,855,704, describes modification of the golf shoe construction or design which involves both shoes. The Schlesinger invention does not permit a good golf stance or swing as described above. It shifts weight in the wrong direction and does not prevent risk of shift of weight to the rear or heel of the foot. O'Brien, U.S. Pat. Nos. 3,218,734 and 4,118,034, describes removable wedge shaped devices which support only a small part of the golfer's foot. The devices do not provide the capability of proper weight transfer discussed above and have the inherent risk of causing the foot to pivot back and forth. Chiroff, U.S. Pat. No. 4,407,079, describes a device for attachment to the left shoe of right handed golfers. The device would hinder the correct weight transfer as discussed above and presents a risk of undesired pivoting. Simmons, U.S. Pat. No. 4,682,425, describes modification of the sole and heel areas of both golf shoes to improve stance and weight distribution of the golfer. The modification is done by changing the design of the sole and heel of the shoes or by a sole insert for each shoe. The modification is designed to cause both knees of the golfer to turn inward and, therefore, would tend to inhibit transfer of weight to the left leg and ball of the foot as discussed above.

SUMMARY OF THE INVENTION

This invention relates to a teaching aid device for golfers. More particularly, the teaching aid device of the present invention provides the golfer with a correct stance and swing. The device is attached, in the case of a right handed golfer, along the outside edge of the bottom of the right golf shoe. The device causes the right foot to tilt or slant inwardly and forwardly simultaneously. The device of the present invention is a generally wedge shaped bar which slopes inward toward the centerline of the foot and also slopes forward from the heel toward the ball of the foot. With the two slopes or angles incorporated in the device, the golfer is placed in the correct golf stance each time it is used. With use of the device over a period of time, the leg and foot muscles become toned or conditioned to assume the correct stance. By imparting good muscle memory through use of the device in practice, the golfer develops consistency of a good golf swing. A consistent golf swing marks the difference between the low handicap golfer and the high handicap golfer. The golf teaching aid device of the present invention is designed for practice purposes only.

DETAILED DESCRIPTION OF THE INVENTION

For purposes of illustration and explanation of the invention, the following detailed description of a preferred embodiment is directed at a device of the present invention for use by right handed golfers. The same principles can be applied to a device to aid left handed golfers.

Figure 6:
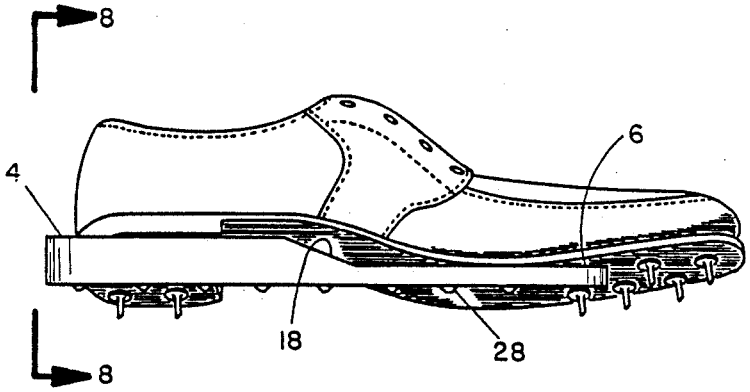
FIG. 6 is a side view of the golf teaching aid of FIG. 1 on a golf shoe on the right foot.
Figure 8:
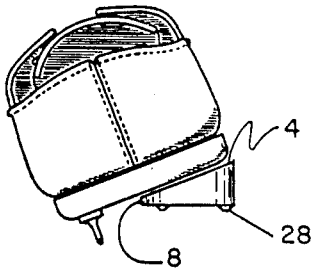
FIG. 8 is a rear view along line 8—8 of FIG. 6.
Figure 5:
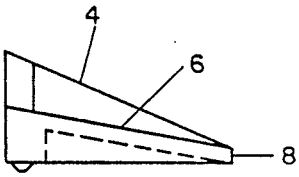
FIG. 5 is a front view of the embodiment of FIG. 2.
Figure 7:
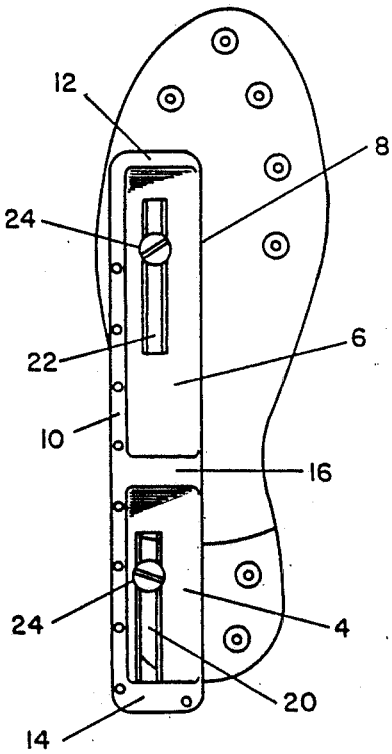
FIG. 7 is a bottom view of the embodiment of FIG. 6.

FIGS. 1–5 show the actual size of a preferred embodiment of the device of the present invention. FIGS. 6–8 show the device of FIGS. 1–5 on a reduced scale.

Figure 1:
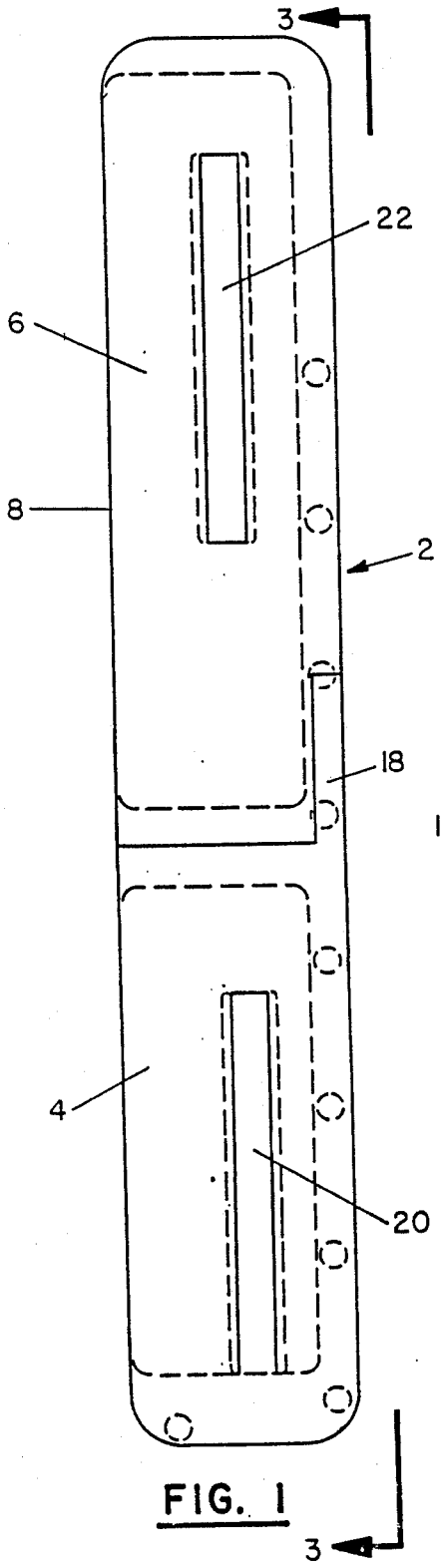
FIG. 1 is a top view of the golf teaching aid of the present invention.
Figure 2:
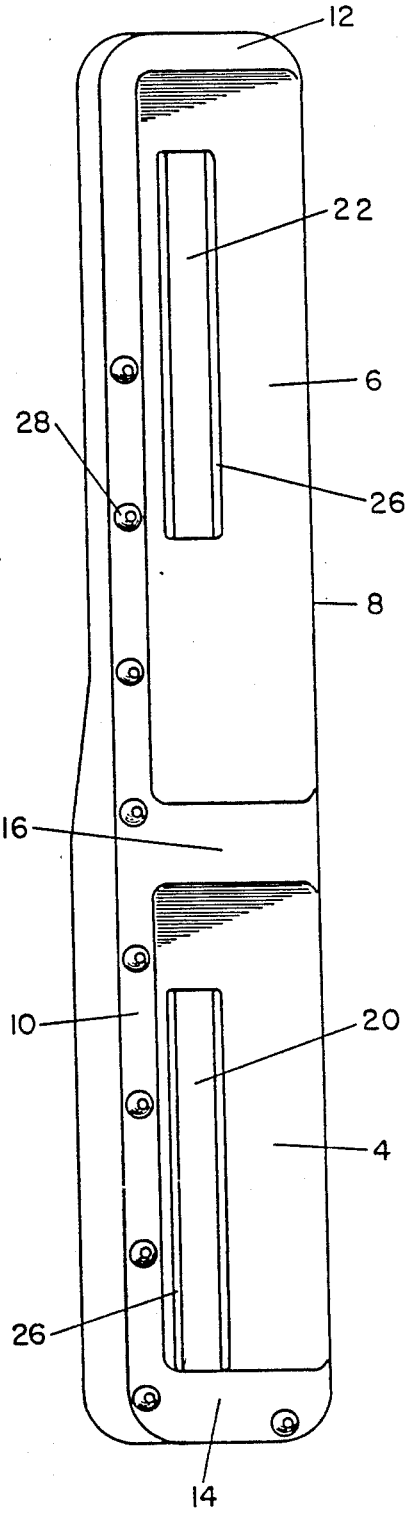
FIG. 2 is a bottom view of the embodiment of FIG. 1.
Figure 3:
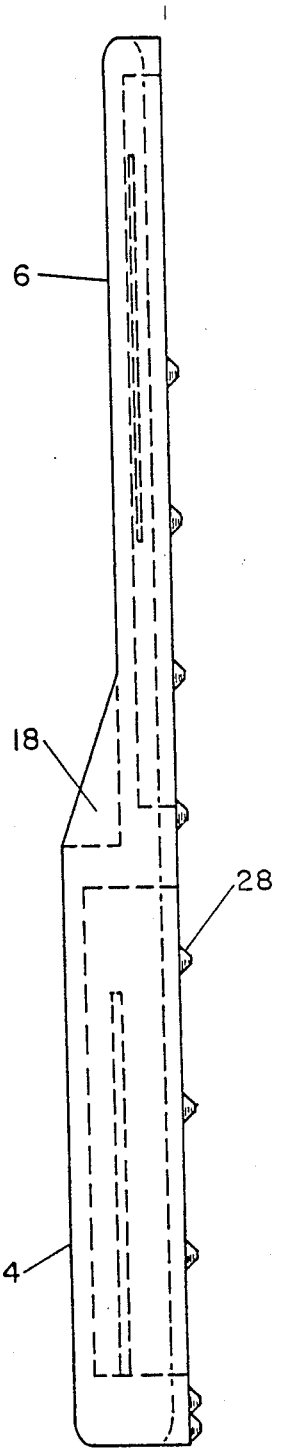
FIG. 3 is a side view along line 3—3 of FIG. 1.
Figure 4:
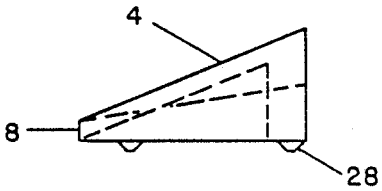
FIG. 4 is a rear view of the embodiment of FIG. 1.

FIG. 1 is a top view of a golf teaching aid device 2 of the present invention. As shown by the top view, the device is in the shape of a rectangular bar with a uniform width of $1\frac{1}{2}$ inches and a length of $9\frac{1}{4}$ inches. The top surface has a heel portion 4 and a front sole portion 6. The length of the heel portion is 4 inches and the front sole portion is $5\frac{1}{4}$ inches. The major surface area of the heel and sole portion has a thickness of $\frac{1}{8}$ inch which is the same as the thickness of the inner edge 8. As best seen in FIGS. 3 and 4, the heel portion is raised slightly relative to the front sole portion. In the preferred embodiment shown, the thickness or height of the outside edge of the heel portion is $\frac{3}{4}$ inch and the outside edge of the front sole is $\frac{3}{8}$ inch. The slightly raised heel portion relative to the front sole portion is an important feature of the invention in that it provides a forward slope or slant to the golfer's foot. Having the foot slanted or tilted forward is an essential part of the golfer's correct stance. The second essential part of a correct stance is to have the foot slanted inwardly. An inward slope of the foot is provided by the device of the present invention by having a wedge shape which is seen best in FIGS. 4, 5 and 8. The inner edge 8 which runs along the centerline of the foot has a uniform thickness or heighth of $\frac{1}{8}$ inch as compared to a thickness or heighth of $\frac{3}{4}$ inch and $\frac{3}{8}$ inch at the outer edge of the heel portion and sole portion, respectively. Thus, when the device is attached to the golf shoe as shown in FIGS. 6–8, the golfer's foot is forced to slant inward. At the same time, the golfer's foot is forced also to slant forward by reason of the slightly raised heel portion 4 relative to the sole portion 6. In this way, the golfer is assured of a correct stance. Because of the inward and forward slopes of the device, it is essentially impossible for the golfer to improperly transfer weight to the outside of of the right leg and foot during the back swing. Strength is built into the device for solid support of the heel and sole portion without sacrifice of flexibility, by a solid outer wall 10 running the length of the device of a thickness of ¼ inch, a solid front wall 12 of a thickness of ¼ inch, a solid wall 14 of a thickness of ½ inch, and a solid wedge shaped bridge 16 at the juncture of the heel and sole portions. For additional strength at the juncture of the heel and sole portions, a solid bridge 18 along the outer edge of the top surface which is tapered toward the sole is provided. The bridge has a width of 3/16 inch and length of 1⅛ inch. In each of the heel portion and sole portion, there is provided a slot or groove 20 and 22, respectively, adapted to receive a screw 24 for securing the teaching aid device to the bottom of the golf shoe. The groove, which measures 2½ inches in length and ¼ inch in width is positioned for advantageous adjustment of the device in accordance with the size of the shoe. A small lip 26 is provided at each side of the grooves which can be cut away if necessary to fit a screw of larger diameter. The grooves as positioned in the embodiment shown are designed to accommodate golf shoe sizes of about 5 to 13. In attaching the device of the present invention, it is generally sufficient to remove 2 or 3 spikes depending upon the style of golf shoe. Small spikes 28 are provided on the bottom surface of outer wall 10 and rear wall 14 for traction. The spikes are suitably about 1/16 to ⅛ inch in length.

The device of the present invention is lightweight, durable and versatile. In addition, it supports essentially the entire length of the golfer's foot and eliminates risk of undesirable pivoting during the back swing and down swing. In other words, it provides exceptional balance and stance. The device can be made by, for example, injection molding using a durable polymeric material having good flexural strength. Suitable polymers include polyethylene, polypropylene, ethylene-propylene copolymer, polybutylane, ABS, polyurethane, polyvinyl chloride , and the like. Various additives such as color pigment, plasticizers, fillers, u.v. stabilizers, and anti-oxidants can be blended into the polymeric material.

By attaching the teaching aid device of the present invention to the golf shoe, the golfer will automatically or naturally be placed in the correct stance or posture when addressing the ball before the start of the golf swing. In other words, the back or right foot will be square with the ball and target after using the device a few times. the wedge shape of the device which tilts or slants the back foot inward will not allow the golfer's weight to transfer to the outside of the back leg and foot during the take away or the back swing. In other words, the inward tilt will keep and maintain the weight transfer to the inside of the back leg and foot during the back swing. With this correct weight transfer, a correct hip turn happens automatically for the golfer. The device of the present invention also has a slant or tilt forward from the heel to the ball of the foot. This forward slant transfers the golfer's weight to the ball of the foot. Putting the golfer's weight on the ball of the foot places the golfer in the most powerful and active stance a golfer can be in during the golf swing. With the combined inward slant and forward slant of the back foot provided by the device of the present invention , the golfer is able to attain the correct stance and swing. With use of the device in practice sessions, the golfer will achieve muscle memory which is needed for a consistent good golf swing. Good muscle memory makes the difference between the low and high handicap golfer.

Although the invention has been described in detail relative to a preferred embodiment, it is to be understood that such was for illustration and explanatory purposes and various modifications in design and dimensions of material can be made by those of ordinary skill in the art without departing from the spirit and scope of the invention.

What is claimed is:

1. A device for removable attachment to the bottom surface of a golf shoe which aids in the teaching of a correct golf stance and swing comprising a generally wedge shaped rectangular bar which causes the golfer's foot to tilt forwardly and inwardly simultaneously, said device being adapted to be worn on the bottom surface and along the outside edge of the golf shoe farthest from the golfer's target; said device having an upper surface which supports essentially the entire length of the golfer's foot, and having on its lower surface a plurality of spikes; said upper surface having a sole supporting portion and a heel supporting portion, the heel portion being raised slightly relative to the sole portion so that the golfer's foot tilts forwardly; said device having a solid outer wall running the length thereof and inner edge running the length thereof, said outer wall being substantially higher than the inner edge so that the golfer's foot is caused to tilt inwardly; said device having a first slot disposed lengthwise in the sole portion and a second slot disposed lengthwise in the heel portion adapted for attaching the device to the shoe and permitting forward and rearward adjustment of the device, said device being constructed of a flexible polymeric material.

2. The device according to claim 1 wherein the height of the outer wall in the heel portion is about six times the height of the inner edge and the height of the outer wall in the sole portion is about three times the height of the inner edge.

3. The device according to claim 2 wherein the inner edge has a uniform height of about one-eighth inch.

4. The device according to claim 3 having an overall length of about 9¼ inches and a uniform width of about 1½ inches.

* * * * *